US006598536B2

(12) United States Patent
Burri

(10) Patent No.: US 6,598,536 B2
(45) Date of Patent: Jul. 29, 2003

(54) MUNITIONS WITH SHATTERING PENETRATOR CARTRIDGE CASE

(75) Inventor: Jakob Burri, Regensdorf (CH)

(73) Assignee: Oerlikon Contraves Pyrotec AG, Zurich (CH)

( * ) Notice: Subject to any disclaimer, the term of this patent is extended or adjusted under 35 U.S.C. 154(b) by 0 days.

(21) Appl. No.: 09/945,977

(22) Filed: Sep. 4, 2001

(65) Prior Publication Data

US 2002/0005138 A1 Jan. 17, 2002

(30) Foreign Application Priority Data

Nov. 23, 2000 (CH) ..... 2000-2279/00

(51) Int. Cl.[7] ..... F42B 14/06; F42B 8/14

(52) U.S. Cl. ..... 102/522; 102/506; 102/517; 102/523; 102/529

(58) Field of Search ..... 102/398, 498, 102/506, 514–518, 520–523, 529

(56) References Cited

U.S. PATENT DOCUMENTS 4,108,074 A 8/1978 Billing, Jr. et al.
4,362,107 A 12/1982 Romer et al.
4,770,102 A * 9/1988 Bisping et al. ..... 102/521
4,854,242 A * 8/1989 Katzmann ..... 102/522
5,505,137 A * 4/1996 Godefroy et al. ..... 102/529

FOREIGN PATENT DOCUMENTS

EP 7695 * 2/1980 ..... 102/529
EP 0 989 381 A2 3/2000
FR 2662789 * 12/1991 ..... 102/529

* cited by examiner

*Primary Examiner*—Harold J. Tudor
(74) *Attorney, Agent, or Firm*—McCormick, Paulding & Huber LLP

(57) ABSTRACT

A sabot projectile (10), comprising a sabot (12) and a shattering penetrator (14) arranged in the sabot (12). The shattering penetrator (14) has a penetrator casing (20), which can be broken into at least two casing portions (22*, 24*) upon impact of the shattering penetrator (14), to which end a predetermined casing breaking area (23*) is respectively arranged between two adjoining casing portions (22*, 24*). A central conduit (30) is arranged in the penetrator casing (20), in which a penetrator core (26) is received, whose core tip element (26.4) projects out of the penetrator casing (20) and constitutes a penetrator tip. The plastic material forming the penetrator core (26) is introduced into the conduit in a flowable state. The penetrator casing (20) is secured against break-up into the casing portions (22*, 24*) by the penetrator core (26).

17 Claims, 4 Drawing Sheets

MUNITIONS WITH SHATTERING PENETRATOR CARTRIDGE CASE

CROSS REFERENCE TO RELATED APPLICATIONS

This application claims priority from and incorporates by reference the subject matter of Swiss Patent Application 2000 2279/00 filed Nov. 23, 2000.

FIELD OF THE INVENTION

The invention relates to a sabot projectile having a sabot and a shattering penetrator, which has a penetrator casing and a penetrator core in a conduit and is arranged in the sabot.

BACKGROUND OF THE INVENTION

Shattering penetrators are used as training munitions. They are designed in such a way that they demonstrate accuracy in hitting on impact, but do no cause great damage in the target area; in particular it is intended to minimize the impact, or ricochet, effects.

Sabot projectiles are used for firing sub-caliber munitions. Sabot projectiles are used as training munitions, because they allow the firing of munitions of small caliber by means of weapons which do not need to be refitted for training purposes, i.e. must be equipped with weapon tubes or weapon tube inserts.

It is obvious that sabot projectiles with shattering penetrators constitute the optimal training munitions.

Such sabot projectiles with shattering penetrators are known, for example, from EP-0 989 381-A2. They have proven themselves in actual use, but are comparatively expensive to produce.

A projectile in the form of a full-caliber shattering penetrator is known from U.S. Pat. No. 4,108,074-A. The penetrator has a penetrator casing made of steel and a penetrator core made of a plastic material. The penetrator casing is cup-shaped and encloses the rear part of the penetrator core, while the front part of the penetrator core protrudes out of the penetrator casing. The penetrator casing has grooves on its circumference, which constitute predetermined breaking points. The break-up of the penetrator casing into several casing elements is intended to occur upon impact. As mentioned above, this is a full-caliber projectile, which does not have a sabot. Therefore a premature break-up of the penetrator casing into its casing elements can only be prevented by the penetrator core itself, since there is no sabot cover which aids in preventing the break-up of the casing elements during loading the projectile into the weapon tube, from which it is to be fired, as well as during firing. Therefore, to prevent the premature break-up into casing elements, the predetermined breaking points are only suggested and have almost no weakening effect. The result of this is that the desired break-up into casing elements on impact also does not take place assuredly. Therefore the use of this scattering penetrator in a sub-caliber projectile would not bring the desired result, namely the assured break-up at any impact angle.

OBJECT AND SUMMARY OF THE INVENTION

Starting with the prior art in accordance with EP-0 989 381-A2, it is therefore the object of the present invention to create an improved sabot projectile with a sub-caliber scattering penetrator, which is simpler to produce than the already known projectiles of this type, and which is at least equally advantageous in its usage.

In accordance with the invention, this object is attained in connection with a sabot projectile of the type mentioned at the outset by providing a unitary penetrator casing having two casing portions with a casing breaking area between the two portions and a central conduit, and a penetrator core constituted by a plastic material which has been introduced in a flowable state into the central conduit of the penetrator casing with a core breaking area adjoining the case breaking area.

Preferred further developments of the sabot projectile of the invention are defined in the specification.

The novel sabot projectile with the sub-caliber shattering penetrator is optimal in production as well as in use.

On impact, the projector casing breaks up into several casing portions at the predetermined casing breaking areas, so that the undesired ricochet effect is reduced, since the individual partial masses are reduced in comparison to the total mass, and the air resistance is increased.

Preferably the partial masses into which the casing breaks up are approximately identical, because of which the ricochet effect as a whole is reduced.

The penetrator core is designed in such a way that it assuredly keeps the casing portions of the penetrator casing and, in case of a penetrator casing composed of several casing elements these casing elements, together, while the sabot projectile is conveyed to the weapon tube, is fired and while it is in flight, but does not hamper the break-up of the casing elements upon impact.

A break-up into the casing portions is assured by the areas of predetermined breaking points located between them, which essentially extend along the circumference, but are not necessarily located in planes vertically in respect to the longitudinal axis of the sabot projectile.

The penetrator core alone could assure the break-up of the penetrator casing into the casing portions during flight. To overcome the stresses being created during the conveyance to the weapon tube and upon firing, the sabot cover also aids in preventing the break-up of the penetrator casing.

As already mentioned, the unitary penetrator casing can be made of one or several casing elements, for example a front casing element and a rear casing element.

If the penetrator is composed of several casing elements, these are preferably directly connected with each other, for example by a threaded section, gluing, soldering or any other connection known per se. However, the casing elements are also indirectly connected with each other by the penetrator core and, prior to their separation from the sabot after leaving the weapon tube, by the sabot.

Predetermined casing breaking points between casing portions are formed, for example, by areas of the penetrator casing having a reduced wall thickness and/or a sudden change in the wall thickness, or which are made of a material different from the rest of the penetrator core.

Preferably, not only does the penetrator casing have predetermined casing breaking points, but the penetrator core also has predetermined core breaking points, which adjoin the predetermined casing breaking points.

Moreover, the penetrator core can have a predetermined tip breaking area located in the area of the back end of the penetrator tip.

The various casing elements can be made from the same or from different materials.

The penetrator core preferably is made of a highly heat-resistant plastic material. Generally this plastic material is filled with suitable particles by means of which it is possible, inter alia, to affect its brittleness when in its state of use. In any case, the penetrator core is made from a material which is flowable during production. In this case it can be a fluid, or pasty, material, which is shaped by means of pressure or injection molding processes. Possibly a powder-like mass could also be used, which afterwards is combined by the application of pressure and/or heat to form a solid body.

The scattering process is affected by a plurality of parameters, in particular by the configuration of the predetermined casing breaking point and the predetermined core breaking point, furthermore by the absolute and relative diameter of the penetrator casing and the penetrator core, and by the choice of a suitable plastic material for the penetrator core.

The invention will be extensively described in what follows by means of an exemplary embodiment, while making reference to the drawings.

DETAILED DESCRIPTION OF THE PREFERRED EMBODIMENT

Figure 1:
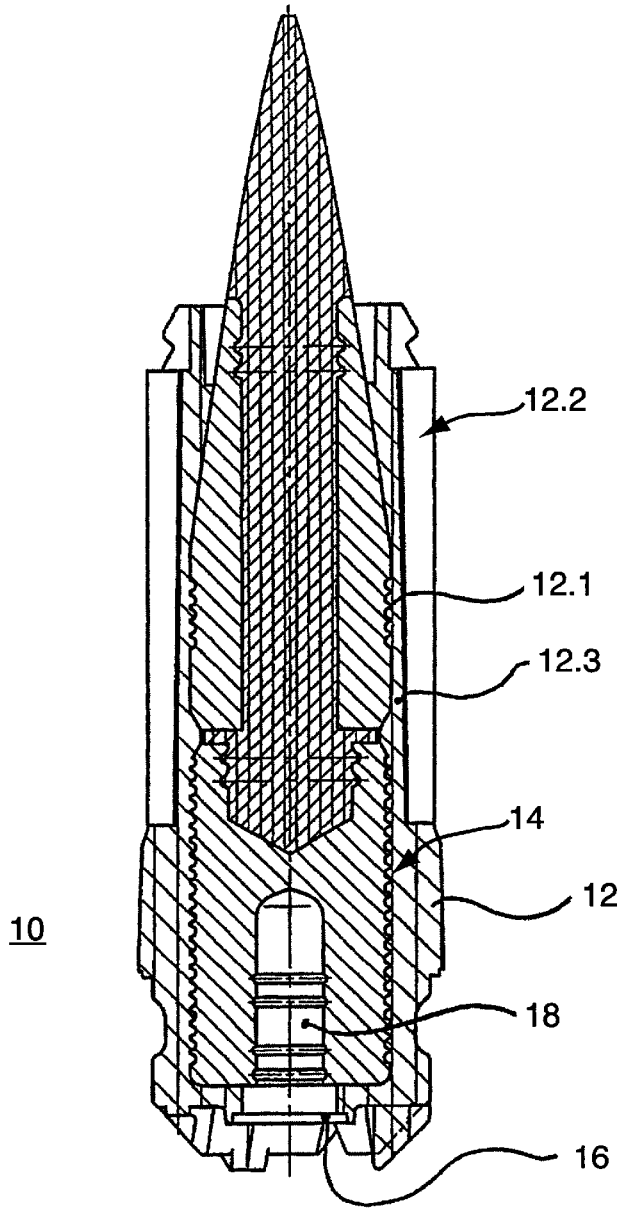
FIG. 1 is a sectional view, containing the longitudinal axis of the projectile, of a sabot projectile with a shattering penetrator in accordance with the invention.
Figure 2:
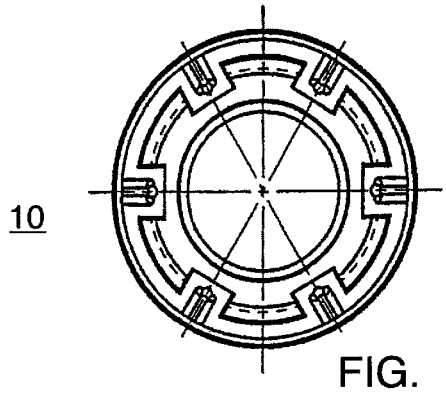
FIG. 2 is a top plan view of the sabot projectile with the shattering penetrator represented in FIG. 1.

FIGS. 1 and 2 show a sabot projectile 10, which is essentially constituted by a sabot 12 and a sub-caliber shattering penetrator 14 with a chamber 18, which is covered by a cover 16 in the form of a small plate, wherein the chamber 18 is used for containing the tracer set, for example. The arrangement of a tracer set, or the chamber 18 intended for that, is not mandatory.

The sabot 12 can be designed, for example, in the way, or similar to the way, of a previously known sabot described in EP-0 989 381-A, i.e. only with a sabot cover, but without a separate sabot bottom. On its inside, the sabot 12 has ring-shaped projections 12.1, between which anchoring flutes are formed; the ring-shaped projections 12.1 protrude into complementary annular grooves, or anchoring flutes 14.1 on the exterior of the shattering penetrator 14. The sabot 12 is divided into several segments 12.2, which are connected with each other by means of predetermined sabot breaking areas 12.3.

Figure 3:
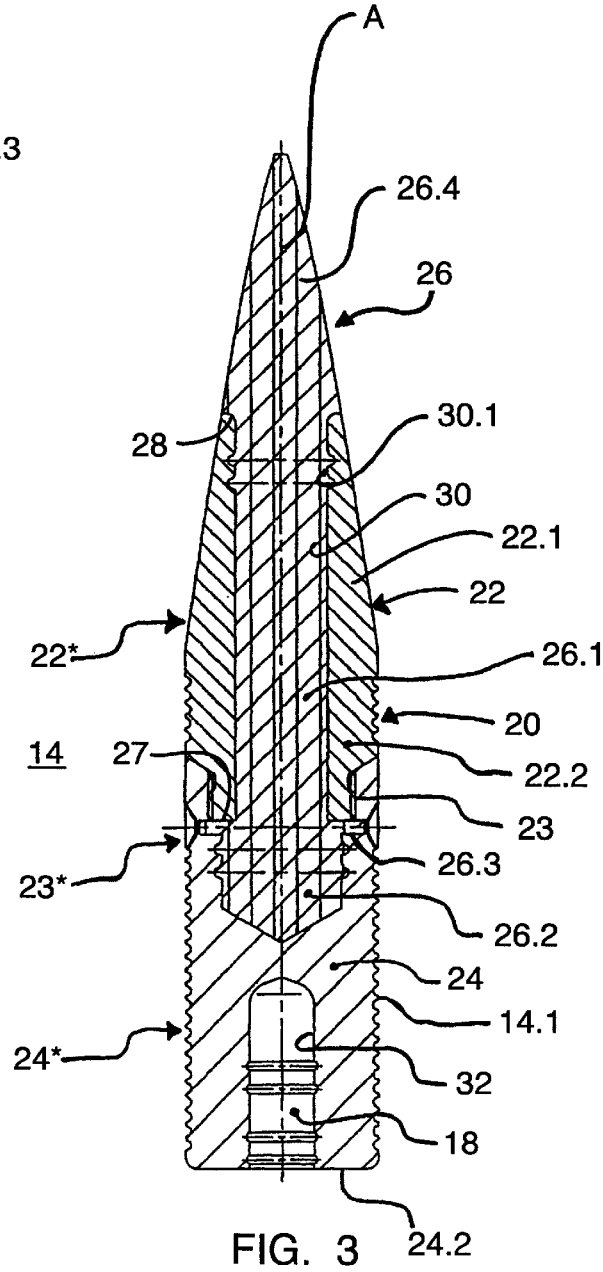
FIG. 3 represents the shattering penetrator of the sabot projectile shown in FIGS. 1 and 2 in a sectional view, containing the longitudinal axis of the projectile.

In accordance with FIG. 3, the sub-caliber shattering penetrator 14 comprises a penetrator casing 20 which, in the present exemplary embodiment, is made from a front casing element 22 and a rear casing element 24, as well as from a penetrator core 26.

The front casing element 22 essentially has the shape of a truncated cone in a front section 22.1 and has a cylindrical border in a rear section 22.2, while the rear casing element 24 is essentially bordered in a cylindrical manner, wherein the exterior diameters of the rear section 22.2 of the front casing element 22 and the rear casing element 24 are equal. The front casing element 22 has an exterior thread at the rear, the rear casing element 24 has an interior thread in its front area; the interior thread and the exterior thread form a screwed connection 23, by means of which the casing elements 22 and 24 are directly connected with each other.

The already mentioned outer circumferential flutes 14.1 are arranged on both casing elements 22 and 24 and are intended to be filled with the material of the sabot cover 12 in such a way that the casing elements 22 and 24 are connected indirectly by the sabot 12 prior to and during firing.

The casing elements 22 and 24 can also be differently shaped and connected with each other differently from the way described above. For example, the rear casing element can have a changing diameter, and the casing elements can also be designed to be stepped. The connection of the two casing elements can also be performed by soldering, gluing, crimping or by any other known joining process, instead of screwing. In other embodiments of the sabot projectile of the invention, the penetrator casing can be made, for example, from only one casing element, or from more than two casing elements. As a whole, penetrator casings with only a single casing element can be produced more efficiently, and the process step of the mutual connection is omitted.

In accordance with FIG. 3, the penetrator casing 20 has a predetermined casing breaking area 23*. With the present sabot projectile 10, this predetermined casing breaking area 23* is located at the rear casing portion 24 directly behind the interior thread. The predetermined casing breaking area 23* is designed and arranged in such a way that upon shattering the penetrator casing 20 breaks up there into a front casing portion 22* and a rear casing portion 24*.

In the present case the front casing portion 22* and the rear casing portion 24* are almost, but not completely, identical to the front casing element 22, or the rear casing element 24. However, this is not mandatory, basically the penetrator casing can be produced from an arbitrary number of casing elements and can be broken up into an arbitrary second number of casing portions. However, it is efficient to put the penetrator casing together from the fewest possible casing elements while, in view of the functioning, as many as possible predetermined casing breaking points, or as many as possible casing elements are often preferred.

In regard to FIG. 3 it should be pointed out that the reference numerals shown in the right half of the shattering penetrator 14 represented there relate to the front casing element 22 and the rear casing element 24, while the reference numerals shown in the left half relate to the front casing portion 22* and the rear casing portion 24*, which are created upon break-up, as well as the predetermined casing breaking area 23*.

Figure 4:
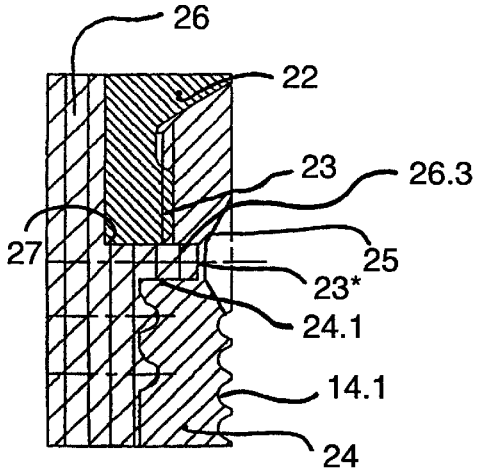
FIG. 4 shows a detail of the shattering penetrator represented in FIG. 3 in an enlarged view.

As FIG. 4 shows, in the present exemplary embodiment the penetrator casing 20, or the rear casing element 24, has a ring-shaped groove 25 on its exterior for forming a uniformly frangible predetermined casing breaking area 23*, because of which the remaining wall thickness becomes extremely thin, namely so thin that the predetermined casing breaking area 23* is practically foil-like. To prevent damage to this predetermined casing breaking area 23* in the course of introducing the flowable mass under pressure for the penetrator core 26, it may become necessary to produce the ring-shaped groove only after the penetrator core 26 has been introduced. The predetermined casing breaking area 23* is arranged in such a way that is subjected to a notching effect starting from the interior of the penetrator casing 20.

The predetermined casing breaking area 23* can also be produced in a way known to anyone skilled in the art by means of the properties of the material instead of the properties of the shape, or by means of a combination of the properties of material and shape of the penetrator casing 20. For example, the casing elements 22 and 24 can be connected by means of an adhesive area, which constitutes the predetermined casing breaking area 23*, with such a configuration, the front casing element 22 would be identical with the front casing portion 22*, and the rear casing element 24 with the rear casing portion 24*.

The front casing portion 22* and the rear casing portion 24*, both inclusive of the longitudinal section of the penetrator core 26 received in them, in an advantageous, but not mandatory manner, have approximately the same mass, which means that the heavier of the two casing portions 22*, 24* constitutes at most two-thirds of the total mass of the two casing portions 22*, 24*.

A continuous central opening is arranged in the front casing element 22, which can be produced by means of a bore, for example, and which constitutes the front portion of a conduit 30, in which a center core section 26.1 of the penetrator core 26 is received. Ring-shaped recesses 30.1 are provided in the frontmost area of this conduit 30, which are filled with the material of the penetrator core 26. The rear casing element 24 has a recess starting at its front face 24.1, which constitutes the rear portion of the conduit 30, but is not continuous, and in which the rear core section 26.2 of the penetrator core 30 is received. This recess has the largest diameter in its frontmost section, so that the penetrator core 26 forms a shoulder 26.3 there. This recess has ring-shaped grooves in its center section, which are filled with the material of the penetrator core 26.

Moreover, the rear casing element 24 has a blind bore 32 starting at its rear face 24.2, which is intended to form a chamber 18 for receiving a tracer set.

As described above, the rear portion of the conduit 30 is embodied to be stepped, and the front portion of the conduit 30 could also be embodied to be stepped. A more intimate connection between the penetrator casing 20 and the penetrator core 26 is provided by such a stepped design, and relative movements between the penetrator casing 20 and the penetrator core 26 can be prevented in particular. Simultaneously, edge areas of the steps in the area of the predetermined casing breaking area 23* can exert the already mentioned notching effect and in this way aid the break-up of the penetrator core upon impact. In this case it is not necessary to produce the conduit 30 with great precision, since the penetrator core 26 must not be fitted by mechanical processing, but is introduced in a flowable state.

The cross sections of the conduit 30 are circular in the present exemplary embodiment; however, the conduit 30 could also have different shapes, for example, the cross section of the conduit 30 could be polygonal or star-like, or have a longitudinal groove in order to prevent a relative rotation between the penetrator core and the penetrator casing.

The casing elements 22 and 24 can be produced from the same or different materials, in particular from metallic materials such as steel, brass, bronze or aluminum, a suitable plastic material is also possible.

The penetrator core 26 has a core tip 26.4, which also constitutes the tip of the shattering penetrator 14. Starting at this core tip 26.4, the already mentioned center core section 26.1 extends rearward through the conduit 30 of the front casing element 22. The center core section 26.1 has circumferential projections, which protrude into recesses of the front casing element 22. The rear core section 26.2, projecting into the rear casing element 24, with the shoulder 26.3 and circumferential projections, which protrude into the grooves of the rear casing element 24, adjoins the center core section 26.1. The projections of the penetrator core 26 and the recesses, or grooves, of the penetrator casing 20 are used for connecting the casing elements 22, 24 directly with the penetrator core 26, and therefore also indirectly with each other.

The penetrator core 26 is designed in such a way that it meets several, partially opposite requirements. Firstly, the penetrator core 26 must be designed in a way that it connects the casing elements 22, 24, or respectively the casing portions 22*, 24* in a such way, that the shattering penetrator 14 withstands the stresses during its conveyance to and into a weapon tube, during firing and after firing, or in flight, without the penetrator casing 20 breaking up in the predetermined casing breaking area 23* before impact, and in particular in a case where the trajectory of the penetrator 14 is subjected to initial perturbations. Although the casing elements 22, 24 are connected by the screwed connection 23, without the penetrator core 26 the penetrator casing 20 would prematurely break up into the casing portions 22*, 24*, in particular when stressed transversely to the longitudinal axis A of the sabot projectile 10, i.e. with comparatively extended trajectories. Secondly, the penetrator core 26 must be designed in such a way that, when the penetrator 14 impacts, its shattering, or the break-up of the penetrator casing 20 into the casing portions 22*, 24*, is not hindered, in particular, the shattering, or the break-up of the penetrator casing 20 is to be assured also if the shattering penetrator 14 impacts at an obtuse angle, since the ricochet effect is minimized by the break-up of the penetrator 14 into several parts. To assist this, the penetrator core 26 has a predetermined core breaking area 27 adjoining the predetermined casing breaking area 23* of the penetrator casing 20, which is produced in that the diameter of the penetrator core 26 abruptly changes without rounding. Moreover, the front casing element 22 is shaped in such a way that a predetermined tip breaking area 28 is formed between the center core section 26.1 and the penetrator tip 26.4.

As already mentioned, the penetrator casing of the described exemplary embodiments can be produced from steel, bronze, brass, or another suitable materials.

The penetrator core is produced from a suitable plastic material, which need not be an industrial plastic, such as nylon. A highly heat-resistant plastic material, for example PEI, PPS or PEEK, was selected for the penetrator core in the described exemplary embodiments. This plastic material preferably contains suitable fillers. Fibers, for example carbon fibers and/or glass fibers, glass beads, powdered mineral rock or other suitable particles such as powder or chips, for example of tungsten or bronze, can be used. By means of the choice of the fillers and possibly by their strictly local arrangement in individual areas of the penetrator core, it is possible in a limited way to affect the mass of the penetrator, the mass distribution inside the penetrator and the partial masses into which the penetrator breaks at impact.

The projectile is advantageously configured in such a way that the plastic material for the penetrator core can be introduced into the penetrator casing without a feed or air opening being required in the rear area of the penetrator casing; thus, the penetrator casing is closed in the rear area and completely surrounds the plastic of the penetrator core; therefore no additional component is necessary for shielding the penetrator core from the hot propulsion gases.

Figure 5:
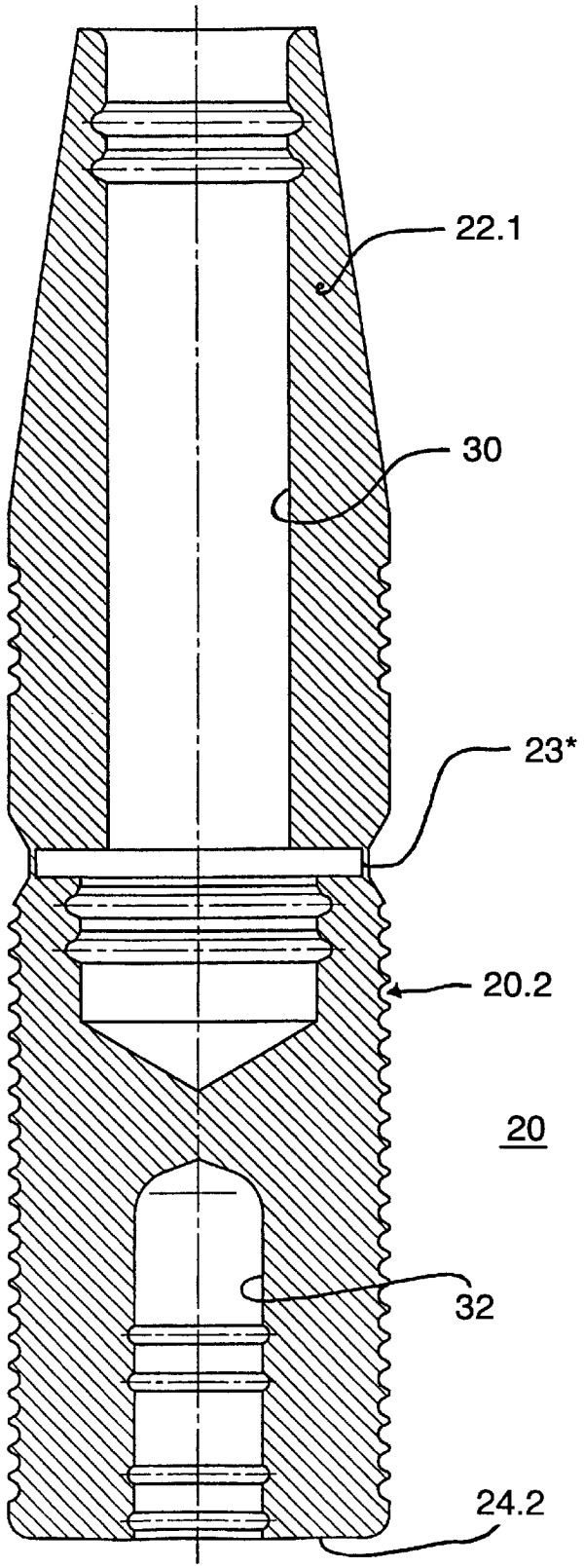
FIG. 5 shows the penetrator casing of a further shattering penetrator in a sectional view, containing the longitudinal axis of the projectile.

A penetrator casing 20 which consists of a single casing element is represented in FIG. 5, but which otherwise is essentially embodied the same and is provided with the same reference numerals as the penetrator casing represented in FIG. 3. The penetrator casing 20 has a forward conical casing area 20.1 and a rear cylindrical casing area 20.2, in which the predetermined breaking area 23* is arranged. The exterior surface of the penetrator casing 20 has circumferential flutes 14.1, and the stepped conduit 30 provided in the penetrator casing 20, as well as the blind bore 32, are designed to be identical to the penetrator casing described above in connection with FIG. 3.

Figure 6A:
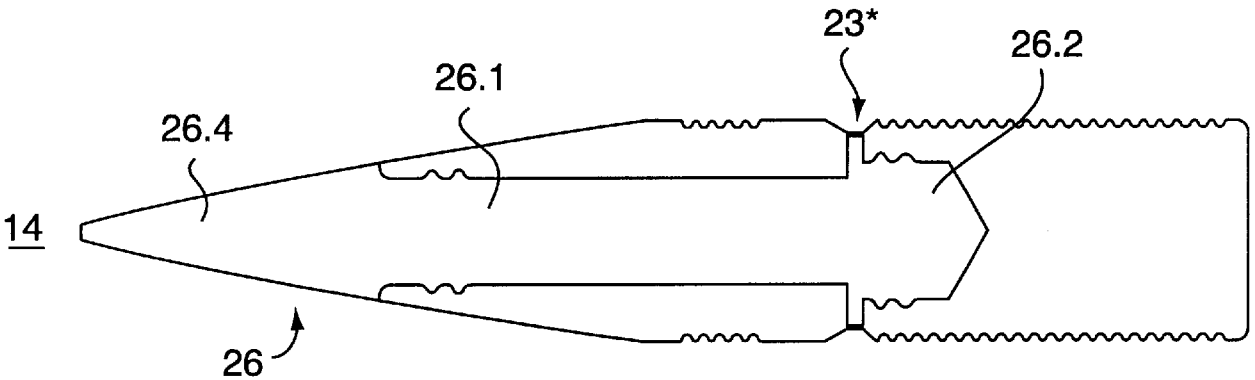
FIG. 6A shows a shattering penetrator in flight.
Figure 6B:
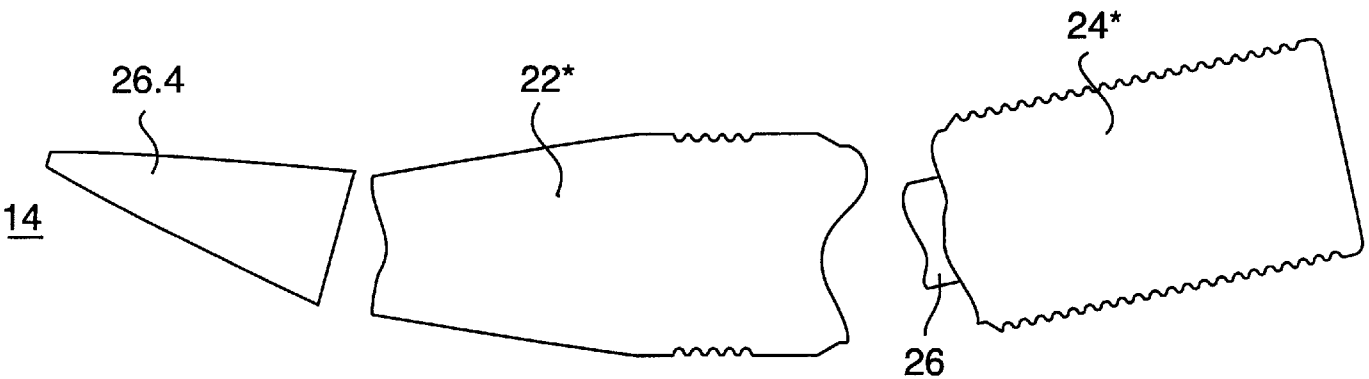
FIG. 6B shows the shattering penetrator represented in FIG. 6A after impact.

FIG. 6A shows a shattering penetrator 14 during flight, namely following the separation from the sabot, not represented, but prior to impact on a target area. The penetrator core 26 with the core tip 26.4, which also constitutes the tip of the shattering penetrator 14, are clearly visible. The front casing portion 22* and the rear casing portion 24* are connected via the predetermined breaking area 23*. The casing portion 22*, 24* and the penetrator core 26 form an integral object. FIG. 6B represents the same shattering penetrator 14 after impact; the shattering penetrator, which originally was constituted as an integral object, has broken up into three partial objects, namely the core tip 26.4, the front casing portion 22* with the center core section 26.1 received therein, and the rear casing portion 24* with the rear core section 26.2 received therein. A small portion of the penetrator core 26 protrudes from the rear casing portion 24*; this shows that, as expected, in the present example the breaking face of the penetrator core 26 does not coincide exactly with the breaking face of the penetrator casing 20.

What is claimed is:

1. A sabot projectile, comprising:

a sabot and a shattering penetrator arranged in the sabot, which has a unitary penetrator casing and a penetrator core the unitary penetrator casing having at least two casing portions and one casing breaking area arranged between each two adjoining casing portions, to allow the shattering penetrator to be broken in the at least two casing portions upon impact, and the unitary penetrator casing defining a central conduit extending between the two casing portions, and the penetrator core being received in the central conduit having a predetermined core breaking area generally adjoining the casing breaking area, and having a core portion protruding from the unitary penetrator casing and constituting a penetrator tip, wherein the penetrator core is made from a solidified plastic material shaped in flowable state while being introduced into the central conduit.

2. The sabot projectile in accordance with claim 1, wherein the casing breaking area is uniformly frangible.

3. The sabot projectile in accordance with claim 1, wherein each casing portion, including the core portion received therein, have approximately identical mass.

4. The sabot projectile in accordance with claim 1, wherein the casing breaking areas are constituted by areas of the penetrator casing of reduced casing wall strengths.

5. The sabot projectile in accordance with claim 1, wherein the central conduit of the unitary penetrator casing has at least two different cross-sections.

6. The sabot projectile in accordance with claim 1, wherein the penetrator tip has a back and the shattering penetrator is designed such that a predetermined tip breaking area is formed at the back of the penetrator tip.

7. The sabot projectile in accordance with claim 1, wherein the penetrator casing is put together from several casing elements.

8. The sabot projectile in accordance with claim 7, wherein the casing elements are directly connected with each other by screwed connection, soldering, gluing, compression or crimping.

9. The sabot projectile in accordance with claim 7, wherein the casing elements are indirectly connected with each other by means of the sabot.

10. The sabot projectile in accordance with claim 1, wherein the casing elements are made from identical material.

11. The sabot projectile in accordance with claim 1, wherein the plastic material is filled with one of the fillers selected from the group consisting of: glass fibers, glass beads, carbon fibers, powdered mineral rock, chips, and powder.

12. The sabot projectile in accordance with claim 1, wherein the conduit has cross-sections that are circular.

13. The sabot projectile in accordance with claim 8, wherein the casing elements are indirectly connected with each other by means of the sabot.

14. The sabot projectile in accordance with claim 1, wherein the casing elements are made from different materials.

15. The sabot projectile in accordance with claim 10, wherein the material is metallic.

16. The sabot projectile in accordance with claim 15 wherein the material is steel, brass, or bronze.

17. The sabot projectile in accordance with claim 14 wherein the different materials of the casing elements are selected from the group consisting of: steel, brass and bronze.

* * * * *